United States Patent [19]

Laesser

[11] Patent Number: 4,534,660

[45] Date of Patent: Aug. 13, 1985

[54] PORTABLE DEVICE INCLUDING A VISIBLE MECHANISM

[75] Inventor: Claude Laesser, La Chaux-de-Fonds, Switzerland

[73] Assignee: ETA S.A., Fabriques d'Ebauches, Switzerland

[21] Appl. No.: 628,056

[22] Filed: Jul. 5, 1984

[30] Foreign Application Priority Data

Jul. 8, 1983 [CH] Switzerland ..... 3756/83

[51] Int. Cl.[3] ..... G04B 19/02; G04B 37/00

[52] U.S. Cl. ..... 368/220; 368/280; 368/318

[58] Field of Search ..... 368/88, 76, 80, 77, 368/220–221, 223, 228, 233, 234, 276, 280, 285, 294, 296, 301, 316, 318, 322, 323

[56] References Cited

U.S. PATENT DOCUMENTS

| | | | |
|---|---|---|---|
| 1,600,889 | 9/1926 | Kislinger | 368/285 |
| 1,740,427 | 12/1929 | Kislinger | 368/285 |
| 2,252,647 | 8/1941 | Schmitz | 368/316 |
| 4,362,397 | 12/1982 | Klingenberg | 368/77 |
| 4,459,032 | 7/1984 | Musy | 368/77 |

*Primary Examiner*—Vit W. Miska

*Attorney, Agent, or Firm*—Pollock, Vande Sande & Priddy

[57] ABSTRACT

The components of a mechanical watch are mounted inside a supporting structure comprising a stack of transparent plates made of corundum, spinel or quartz. Some of the plates are formed with cut-outs which define in the assembled structure housings for accommodating said components.

6 Claims, 2 Drawing Figures

PORTABLE DEVICE INCLUDING A VISIBLE MECHANISM

BACKGROUND OF THE INVENTION

This invention relates to a portable device of the kind including a mechanism comprising a source of energy, a rotary drive member supplied by the source and a gear-train driven by the rotary drive member.

Portable devices of this kind include, for instance, wrist watches and pocket watches. The aesthetics appearance of such watches is generally determined by the case, the dial and the hands. In some watches of more original design, known as skeleton watches, the movable parts are visible at least to some extent.

SUMMARY OF THE INVENTION

An object of the invention is to provide a device of the kind set forth which, unlike known devices of this kind, not only provides extensive visibility of its component parts but also provides interesting aesthetic effects.

According to the invention there is provided a portable device including a mechanism comprising a source of energy, a rotary drive member supplied by the source and a train of gear wheels and pinions driven by the rotary drive member, and including a supporting structure comprising a stack of transparent plates with some of the plates being formed with cut-outs which together with adjacent plates define housings which enclose the component parts of the mechanism.

DETAILED DESCRIPTION

Figure 1:
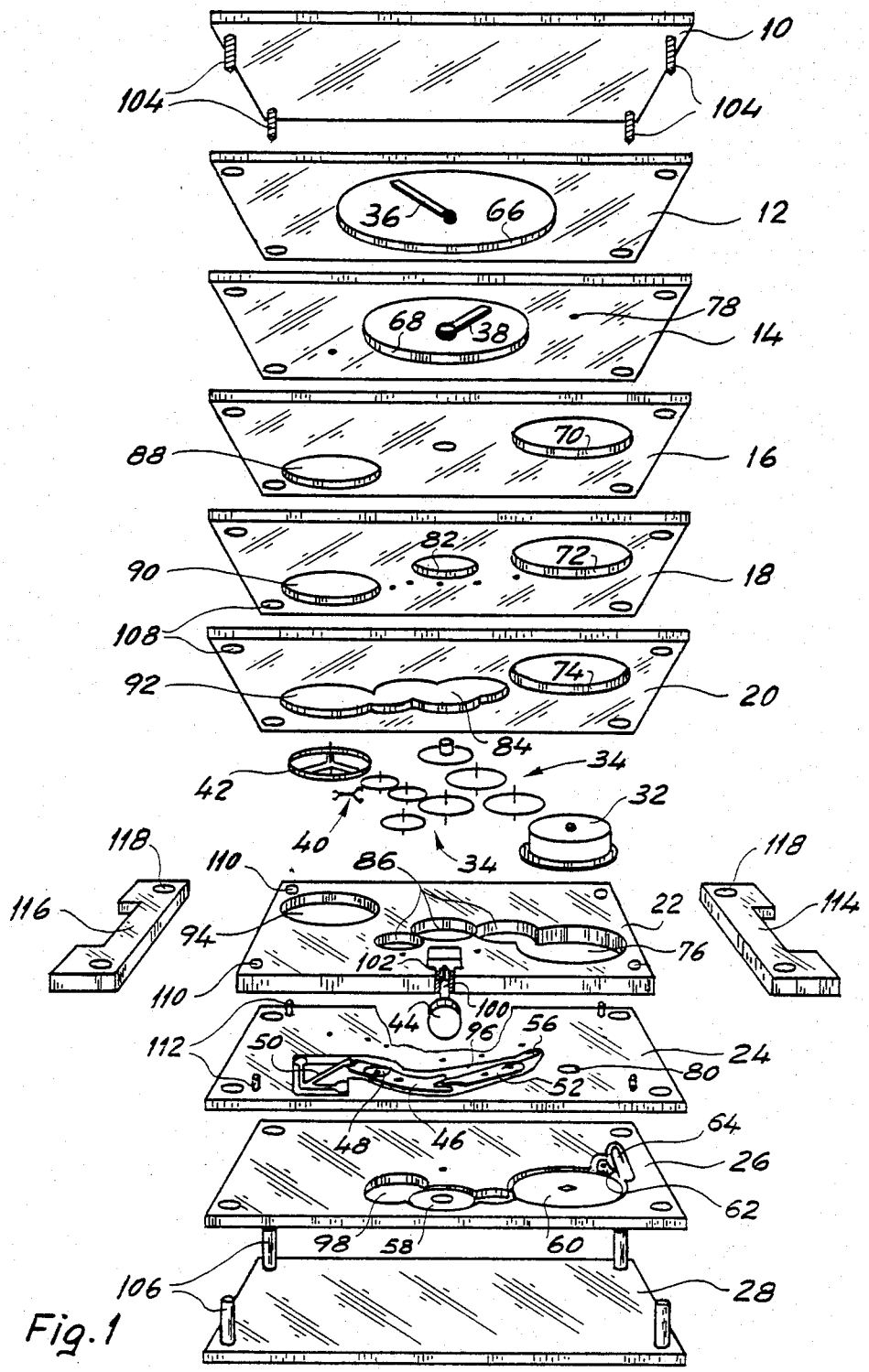
FIG. 1 is an exploded view of a watch provided with a supporting structure according to the invention.
Figure 2:
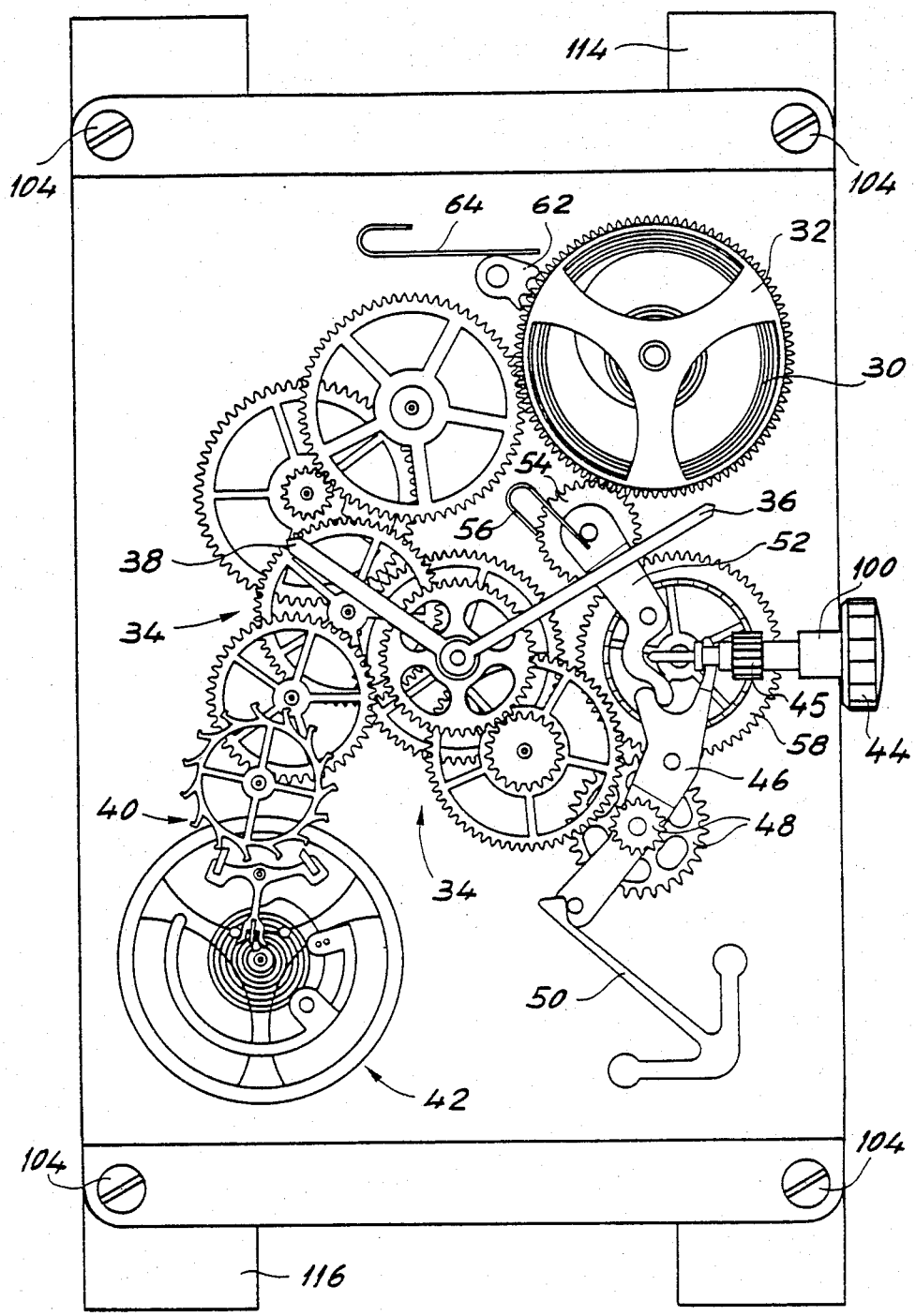
FIG. 2 is a plan view of the watch shown in FIG. 1.

The watch shown in FIGS. 1 and 2 comprises a supporting structure made up of a stack of rectangular plates referenced by even numbers 10 to 28. Plates 10 to 28 are made of transparent material, e.g. corundum (sapphire ruby), spinel and quartz, even glass and plastics.

Uppermost or front plate 10 forms the crystal or glass and the lowermost plate 28 forms the back.

Plates 12 to 26 are formed with inner cut-outs, such as to form, when stacked, enclosures which surround the component parts of the watch movement. The latter is shown in detail in FIG. 2 and is only shown in a rather schematic form in FIG. 1.

The watch movement includes:

a spring 30 (only visible in FIG. 2) forming an energy source;

a barrel 32 containing spring 30 and forming a rotary drive member;

a gear-train 34 coupled to the barrel;

a minutes-hand 36 and an hours-hand 38 driven by the gear-train;

an escapement 40 and a balance 42 for regulating the movement of the gear-train;

a stem 44 on which is mounted a pinion 45 (only visible in FIG. 2); and a winding and setting mechanism comprising a setting-lever 46 actuatable by stem 44, a setting-wheel 48 rotatably mounted on setting-lever 46, a spring 50 acting on setting lever 46, a rocking lever 52 actuatable by setting-lever 46, a winding-wheel 54 (only visible in FIG. 2) rotatably mounted on rocking lever 52, a rocking lever spring 56, a crown-wheel 58 rotatably driven by pinion 45 and meshing with setting-wheel 48 and winding-wheel 54, a ratchet-wheel 60 (only visible in FIG. 1) mounted on the arbor of barrel 32 and a pawl 62 with its associated spring 64.

Plate 12 has a circular opening 66 and plate 14 has a circular opening 68 of smaller diameter within which are respectively accommodated minutes-hand 36 and hours-hand 38, respectively.

Barrel 32, containing spring 30, is accommodated in a housing formed by circular openings 70,72,74 and 76 respectively cut in plates 16,18,20 and 22. The end portions of the barrel arbor pivot in holes 78 and 80 made in plates 14 and 24 respectively.

Gear-train 34 and escapement 40 are accommodated in a housing formed by suitably shaped openings 82, 84 and 86 cut in plates 18,20 and 22 respectively, and pivot in holes (not referenced) made in plates 16,18 and 24.

Balance 42 is accommodated in a housing defined by circular openings 88,90,92 and 94 cut in plates 16,18,20 and 22 respectively and pivots in holes (not referenced) made in plates 14 and 24.

Components 46 to 64, of the winding and setting mechanism, are accommodated in a housing defined by openings 96 and 98 provided in plates 24 and 26. Setting-lever 46 and rocking lever 52 pivot in holes (not referenced) made in plate 22, while crown-wheel 58 and pawl 62 pivot in holes (not referenced) in plate 24.

Stem 44 pivots in a tube 100 secured with adhesive in a housing 102 provided in plate 22.

Plates 10 to 28 are assembled by means of four screws 104 and four internally threaded studs 106 extending through holes 108 formed in each plate except plate 22.

Plate 22, which is shorter than the others, is formed with four holes 110 engageable with four locating studs 112 on plate 24. This arrangement makes it possible for a pair of wristlet attachment elements 114 and 116 formed with holes 118 to be inserted between plates 20 and 24 at the opposite ends of plate 22 for the passage through holes 118 of studs 106.

Plate 22 is here thicker than the others to enable the fitting of a setting stem and wristlet attachment elements that are sufficiently strong to withstand the normal strains to which a watch may be subjected.

The openings in the plate may be cut by any suitable means. In the case of corundum and spinel, the cutting is best done with a laser beam or ultrasonically. As for quartz, it can more readily be cut by resorting to a photo-chemical process.

Clearly, the invention is not limited to the single embodiment just described. For instance, the number of plates in the stack may be increased or reduced. The shape of the openings formed in the plates may correspond quite closely to the shape of the component parts of the movement, as shown in FIG. 1, or may differ therefrom so as, in itself, to provide particular aesthetic effects. In any event, the openings in each plate in the stack and the adjacent plates define enclosures which surround the components of the mechanism, as shown in FIG. 1.

Thus, the invention makes it possible not only, by resorting to transparent plates, to produce a watch in which all of its component parts are visible, but also, by varying the colour of the plates and the shape of their openings, to create most distinctive aesthetic effects that impart to the assembly as a whole an appearance not unlike that of a stained glass window.

A very thin coloured coating, say a few microns thick, may also be applied on the plates to enhance the aesthetics of the watch.

With the use of corundum, a particularly remarkable watch may be produced. Corundum has mechanical properties that provide the watch with great resistance to abrasion. Further, with corundum it is possible to produce plates having a thickness of 0.2 to 0.3 mm, thereby increasing the number of plates that can be used and hence increasing the potential for aesthetic effects.

The use of hard materials, particularly corundum and spinel, but quartz too, and the possibility of being able to limit to the strict minimum, compared with a skeleton watch, the extent of the hollows that weaken the structure, make it possible to produce a watch that is thin, that has a particularly outstanding appearance, that has excellent rigidity and that leaves its movable parts visible.

The resulting effect from the aesthetic point of view is such that it can in itself be self-sufficient and that as a result the time display function may be dispensed with, leaving only a collection of opaque parts integrated in a kind of stained glass body.

I claim:

1. A portable device including a mechanism, said device comprising:

a source of energy;

a rotary drive member driven by said source;

a train of gear wheels and pinions driven by said rotary drive member;

a transparent front plate;

a back plate; and a support structure positioned between said front and back plates, said support structure comprising a plurality of transparent plates which together with said front and back plates form a stack, at least a portion of said plurality of transparent plates comprising cutouts which in cooperation with adjacent plates define enclosures surrounding said source, said rotary drive member and said train of gear wheels and pinions.

2. A portable device as in claim 1, wherein said mechanism is a watch movement.

3. A portable device as in claim 1, wherein said rotary drive member and said wheels and pinions of said train are pivotably mounted in at least a portion of said plates.

4. A portable device as in claim 1, wherein said plates are of a material selected from the group consisting of corundum, spinel, quartz and glass.

5. A portable device as in claim 1, wherein said back plate is transparent.

6. A portable device as in claim 1, wherein said source said rotary drive member and said train of gear wheels and pinions are visible through said stack of plates.

* * * * *